US006030237A

United States Patent [19]

Roth

[11] Patent Number: 6,030,237

[45] **Date of Patent: *Feb. 29, 2000**

[54] PLUG CONNECTOR HAVING A LEAD EXIT DUCT

[75] Inventor: Michael Roth, München, Germany

[73] Assignee: Siemens Aktiengesellschaft, Munich, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 09/178,321

[22] Filed: Oct. 23, 1998

Related U.S. Application Data

[63] Continuation of application No. 08/533,106, Sep. 25, 1995, abandoned, which is a continuation of application No. PCT/DE94/00128, Feb. 8, 1994.

[30] Foreign Application Priority Data

Mar. 23, 1993 [DE] Germany ..... 93 04 393 U

[51] Int. Cl.[7] ..... H01R 13/62

[52] U.S. Cl. ..... 439/157; 439/466; 439/468; 439/473; 439/446; 439/447

[58] Field of Search ..... 439/157, 446, 439/447, 470, 709, 152, 153, 154, 155, 159, 160, 468, 466, 473, 372

[56] References Cited

U.S. PATENT DOCUMENTS

| | | | |
|---|---|---|---|
| 3,794,960 | 2/1974 | Sugar | 439/459 |
| 4,168,877 | 9/1979 | Little et al. | 439/157 |
| 4,582,378 | 4/1986 | Fruchard | 439/157 |
| 5,172,998 | 12/1992 | Hatagishi | 439/157 |
| 5,460,534 | 10/1995 | Taniuchi et al. | 439/157 |

FOREIGN PATENT DOCUMENTS

| | | | |
|---|---|---|---|
| 0 183 939 A2 | 6/1986 | European Pat. Off. . | |
| 0 556 762 A1 | 8/1993 | European Pat. Off. . | |
| 94022183 | 9/1994 | European Pat. Off. | 439/157 |
| 0 691 040 B1 | 1/1996 | European Pat. Off. . | |
| 91 03 107 | 7/1991 | Germany . | |
| 92 07 881 | 8/1992 | Germany . | |
| 42 06 568 A1 | 9/1992 | Germany . | |

*Primary Examiner*—Paula Bradley
*Assistant Examiner*—Tho D. Ta
*Attorney, Agent, or Firm*—Herbert L. Lerner; Laurence A. Greenberg

[57] ABSTRACT

A plug connector includes a housing being made of insulating material and having a lower surface for the passage of plug pins, an upper surface opposite the lower surface, and an open end between the lower and upper surfaces. Contact elements are disposed between the lower and upper surfaces and form plug elements being directed toward the lower surface for connection to leads in the direction of the upper surface. A lead exit duct is disposed in the vicinity of the upper surface and the open end, for routing the leads out of the housing. A closure plate covers the open end of the housing, except for the lead exit duct. The upper surface of the housing has a recess formed therein being open in the direction of the open end of the housing, to permit a lead to exit. As a result, a variable outgoing lead connection is made possible through an angular range of approximately 90° due to a shortened lead exit duct integrated into the housing.

11 Claims, 2 Drawing Sheets

PLUG CONNECTOR HAVING A LEAD EXIT DUCT

CROSS-REFERENCE TO RELATED APPLICATION

This application is a continuation of nonprovisional application No. 08/533,106, filed Sep. 25, 1995, now abandoned which is a Continuation of International Application Serial No. PCT/DE94/00128, filed Feb. 8, 1994.

BACKGROUND OF THE INVENTION

1. Field of the Invention

The invention relates to a plug connector having the following features:

a) a housing made of insulating material, having a lower surface for the passage of plug pins, having an upper surface opposite to the lower surface, and having an open end between the lower surface and the upper surface;

b) contact elements which are disposed between the lower surface and the upper surface form plug elements directed toward the lower surface and can be connected to leads in the direction of the upper surface;

c) the leads are routed out of the housing in a lead exit duct in the region of the upper surface and the end; and d) the open end of the housing is covered by a closure plate, except for the lead exit duct.

Such a plug connector is disclosed in German Utility Model 91 03 107 U and German Utility Model 92 07 881 U. In that case, the lead exit duct is formed by a guide element, which projects as an extension of the upper surface on the open end of the housing, and a clamping clip of the closure plate, lying underneath the guide element and extending in the same direction. The outgoing leads are consequently routed out of the housing through the above-mentioned lead exit duct, perpendicularly with respect to the insertion direction of the plug connector. The outgoing lead connection thus has a fixed angle of 90° with respect to the insertion direction. In the case of plug connectors of that type, it is also known to place the lead exit duct obliquely with respect to the insertion direction, with the result that the outgoing lead connection has a fixed angle of 45°, for example, with respect to the insertion direction.

However, since it is intended to be able to use plug connectors of that type for different installation conditions, an outgoing lead connection having a fixed angle is not always advantageous.

SUMMARY OF THE INVENTION

It is accordingly an object of the invention to provide a plug connector having a lead exit duct, which overcomes the hereinafore-mentioned disadvantages of the heretofore-known devices of this general type and which has an outgoing lead connection with an angle that is variable to a large extent.

With the foregoing and other objects in view there is provided, in accordance with the invention, a plug connector, comprising a housing being made of insulating material, having a lower surface for the passage of plug pins, an upper surface opposite the lower surface, and an open end between the lower surface and the upper surface; contact elements being disposed between the lower surface and the upper surface, the contact elements forming plug elements being directed toward the lower surface for connection to leads in the direction of the upper surface; a lead exit duct being disposed in the vicinity of the upper surface and the open end, for routing the leads out of the housing; a closure plate covering the open end of the housing, except for the lead exit duct; and the upper surface of the housing having a recess formed therein being open in the direction of the open end of the housing, to permit a lead to exit.

In the case of a plug connector of this type, a fixed lead exit duct projecting as an extension laterally from the housing of the plug connector is not provided, but rather the lead exit duct is formed by a recess on the upper surface of the housing and is thus shifted into the housing, that is to say it is shortened. As a result of the recess forming a partial opening between the closure plate and the upper surface, the leads can be bent at different angles with a sufficiently large bend radius. The result is an outlet which is variable through an angle of approximately 90°, for example approximately from a horizontal position to approximately a vertical position upward, that is to say in the insertion direction. The outgoing lead connection is consequently freely variable in a large angular range. As a result, in the case of a plug connector according to the invention, it is possible to adapt the outgoing lead connection to the different installation conditions in the context of the possibilities provided by the partial opening of the housing.

Plug connectors of the type mentioned in the introduction are often constructed with a detent clip for the purpose of locking the housing to another plug connector. The clip is protected from unauthorized actuation in its locking position, for example through the use of a seal. For this purpose, the housing of the known plug connectors is provided with eyes which protrude on both side walls, are disposed in the region of the open end and of the lead exit duct and interact with lateral eyes of the detent clip.

In accordance with another feature of the invention, the leads are disposed in a line bundle having a given width, the housing has side walls between the lower surface and the upper surface, and the recess has a width between the side walls being approximately equal to the given width.

In accordance with a further feature of the invention, the upper surface has a given width, the housing has side walls, and the recess in the upper surface extends approximately over all of the given width from one of the side walls to the other of the side walls.

In accordance with an added feature of the invention, the leads are disposed in a line bundle having a given thickness, and the recess has a depth being approximately equal to the given thickness.

In accordance with an additional feature of the invention, the side walls of the housing have web-like extensions being raised above the upper surface, and the recess has a width being laterally limited between the side walls of the housing by the web-like extensions.

In accordance with yet another feature of the invention, there is provided a transverse web connecting the web-like extensions and being raised on the upper surface of the housing, the recess having a depth being limited by the transverse web.

In accordance with yet a further feature of the invention, the open end of the housing has a given height, and the closure plate has a height being approximately equal to ⅔ of the given height.

In accordance with yet an added feature of the invention, a possible seal of this type is achieved by providing a hole in at least one side wall of the housing which is disposed in such a way that, in a locking position of a detent clip which is provided on the housing for the purpose of locking another plug connector to the housing, it is congruent with a hole provided in the detent clip. In this case, the sealing eyes are shifted onto the upper surface of the plug connector housing and of the detent clip. In this way, the width of the plug connector can be reduced by about 5 mm in comparison with the known plug connectors.

In accordance with a concomitant feature of the invention, one of the side walls of the housing has a web-like extension with a continuation extending beyond an end of the recess, and the hole in the one side wall is disposed in the continuation.

Other features which are considered as characteristic for the invention are set forth in the appended claims.

Although the invention is illustrated and described herein as embodied in a plug connector having a lead exit duct, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
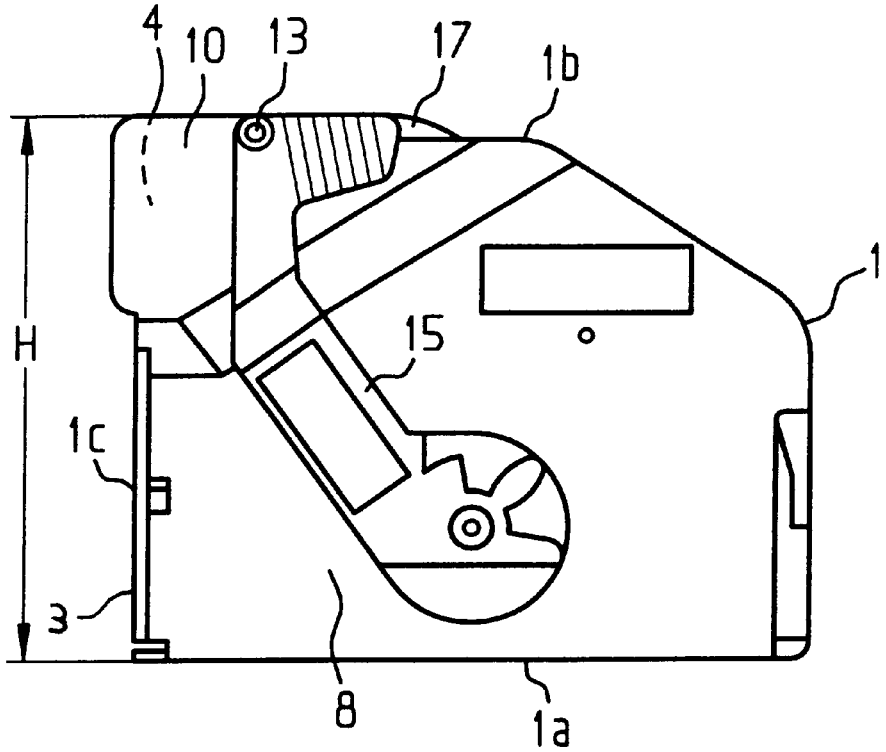
FIG. 1 is a diagrammatic, side-elevational view of a plug connector housing.
Figure 2:
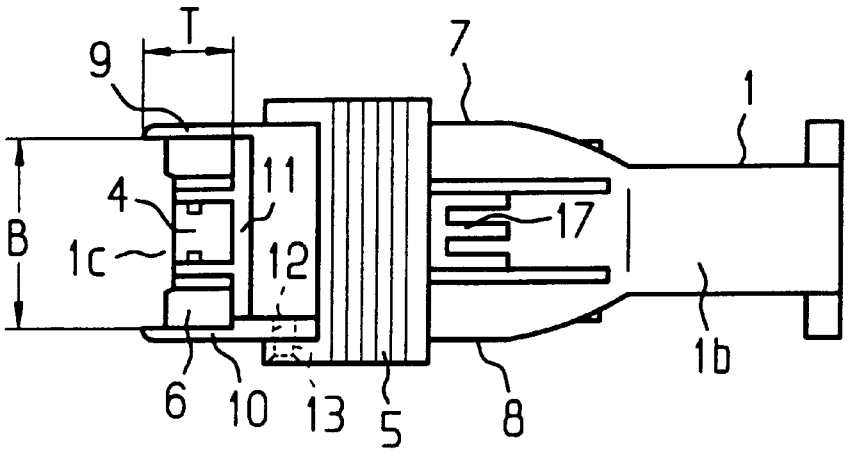
FIG. 2 is a top-plan view of the plug connector housing.
Figure 3:
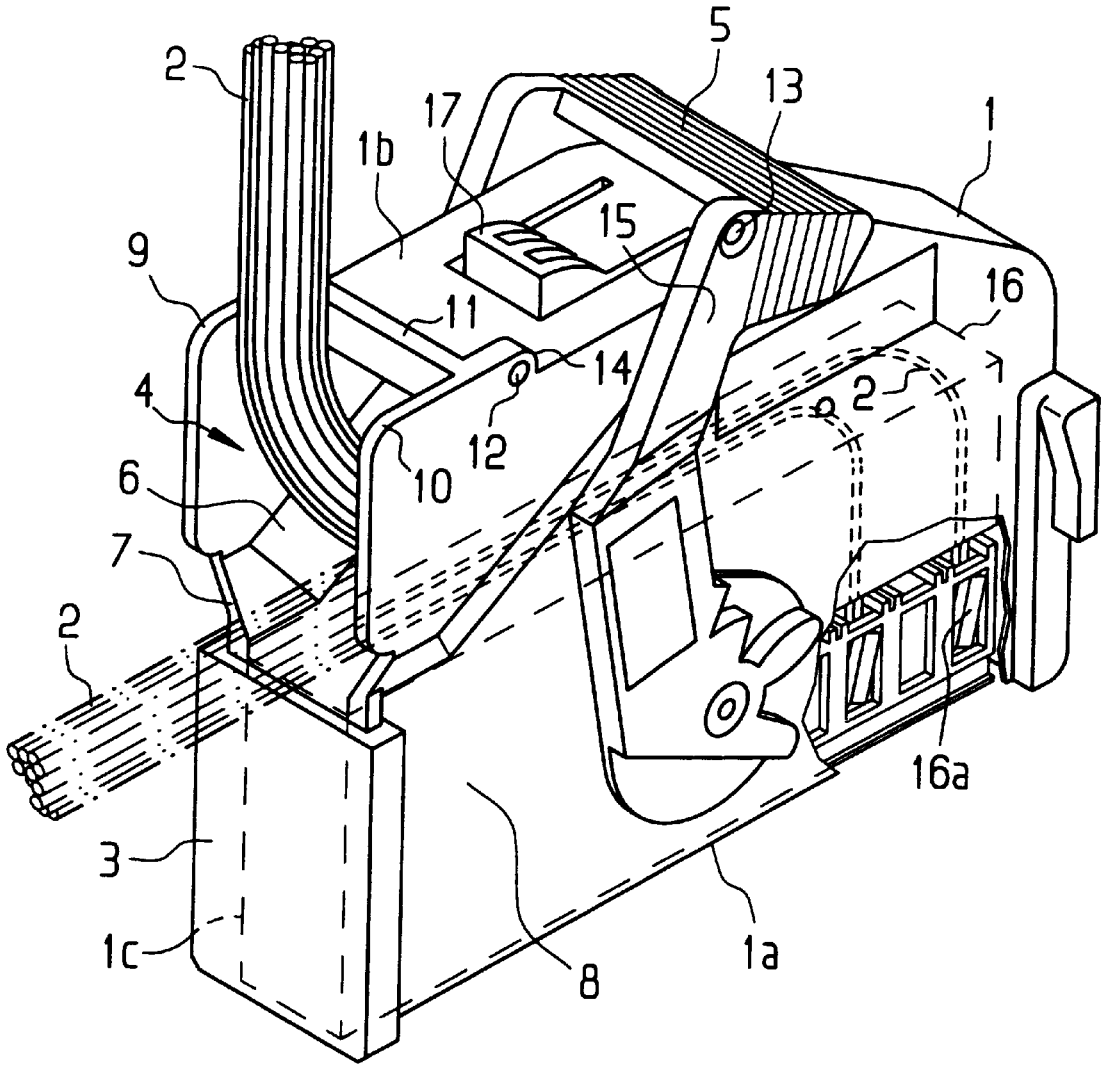
FIG. 3 is a perspective view of the plug connector housing.

Referring now in detail to the figures of the drawing as a whole, there is seen a plug connector housing 1 which is formed of insulating material and has a lower surface 1*a*, an upper surface 1*b* opposite the lower surface, and a front, open end 1*c* between the lower surface and the upper surface. A contact carrier 16, which contains a number of contact elements 16*a* can be pushed in at this open end of the housing 1. The carrier may, for example, be a one-part or two-part female strip connector. The contact elements form plug elements, for example contact sockets, which are directed toward the lower surface and into which plug pins of a mating piece, for example a male strip connector, are inserted. At the other end, that is to say in the direction of the upper surface 1*b*, the contact elements can be connected in a known manner, for example through the use of an IDC connection, to ends of leads of a lead bundle 2, which is illustrated by broken lines in FIG. 3. Following this connection and after the contact carrier 16 has been pushed into the housing 1, the initially open end 1*c* is partially covered by a closure plate 3. The leads of the lead bundle 2 are routed out of the housing in a lead exit duct 4 in the vicinity of the upper surface 1*b* and the end 1*c*. In the plugged-together state of the female strip connectors and male strip connectors, the housings thereof are locked together through the use of a detent clip 5 which, for example, is pivotably supported on the plug connector housing 1. The plug connector housing 1 serves in this case as a socket housing. The detent clip 5 is secured in a locking position (shown in FIGS. 1 and 2) through the use of a resilient detent element 17 on the upper surface 1*b*.

The lead exit duct 4 is formed in this case between the closure plate 3 and the upper surface 1*b* of the housing 1 by providing the upper surface of the housing with an opening or a recess 6 which is open in the direction of the open end 1*c*. The width B of the recess 6 between side walls 7 and 8 of the housing corresponds approximately to the width of the lead or line bundle 2, and the recess extends in this case from the rear side wall 7 to the front side wall 8, that is to say over the entire width of the upper surface 1*b*. The depth T of the recess 6 corresponds approximately to the thickness of the line bundle 2. The recess 6 is laterally limited in terms of its width B between the side walls 7, 8 through the use of web-like extensions 9, 10 of the side walls and the web-like extensions are raised above the upper surface 1*b*. The recess 6 is limited in terms of its depth T through the use of a transverse web 11 which connects these extensions and is raised on the upper surface 1*b*. The lead exit duct 4 is limited in the direction of the initially open end 1*c* of the housing 1 through the use of the closure plate 3, the height of which is approximately equal to ⅔ of the height H of the end 1*c*. Therefore, the leads can leave through a variable angle of approximately 90° and even, if necessary, through a larger angular range, over the upper edge of the closure plate 3 on one hand and over the transverse web 11 on the other hand. Moreover, the lead exit duct is integrated into the housing in this construction, with the result that the external dimensions of the housing 1 are also reduced thereby.

In order to seal the locking position of the detent clip 5 in the plugged-together state of the female strip and male strip connectors, a hole 12 is provided in at least one side wall 8 of the housing 1 and is disposed in such a way that, in the locking position of the detent clip 5, it is congruent with a hole 13 provided in the detent clip 5. In this case, the hole 12 is expediently disposed in a continuation 14 of the web-like extension 10 of the front side wall 8 of the housing 1. The continuation 14 goes beyond the end of the recess 6. The hole 13 is located in an upper corner region of a front clip arm 15 of the detent clip 5. As a result of these measures, the width of the housing 1 across the side walls 7, 8 can be reduced by approximately 5 mm in comparison with the known plug connectors of this type.

I claim:

1. A plug connector, comprising:

a) a housing made of insulating material, said housing having a lower surface for the passage of plug pins, an upper surface opposite said lower surface, and an open end between said lower surface and said upper surface, said upper surface having an opening formed therein adjacent said open end;

b) contact elements disposed between said lower surface and said upper surface, said contact elements forming plug elements being directed toward said lower surface for connection to leads in the direction of said upper surface;

c) a closure plate partially covering said open end of said housing; and d) said opening in said upper surface and said open end of said housing forming a lead exit duct allowing the leads to exit said exit duct at an angle that is variable by approximately 90°.

2. The plug connector according to claim 1, wherein the leads are disposed in a line bundle having a given width, said housing has side walls between said lower surface and said upper surface, and said opening has a width between said side walls being approximately equal to the given width.

3. The plug connector according to claim 1, wherein said open end of said housing has a given height, and said closure plate has a height being approximately equal to ⅔ of said given height.

4. The plug connector according to claim 1, wherein said upper surface has a given width, said housing has side walls, and said opening in said upper surface extends approximately over all of said given width from one of said side walls to the other of said side walls.

5. The plug connector according to claim 1, wherein the leads are disposed in a line bundle having a given thickness, and said opening has a depth being approximately equal to the given thickness.

6. The plug connector according to claim 4, wherein said side walls of said housing have web-like extensions being raised above said upper surface, and said opening has a width being laterally limited between said side walls of said housing by said web-like extensions.

7. The plug connector according to claim 6, including a transverse web connecting said web-like extensions and being raised on said upper surface of said housing, said opening having a depth being limited by said transverse web.

8. The plug connector according to claim 5, wherein said side walls of said housing have web-like extensions being raised above said upper surface, and said opening has a width being laterally limited between said side walls of said housing by said web-like extensions.

9. The plug connector according to claim 8, including a transverse web connecting said web-like extensions and being raised on said upper surface of said housing, said opening having a depth being limited by said transverse web.

10. The plug connector according to claim 1, including a detent clip having a hole formed therein and being movable into a locking position for locking another plug connector to said housing, said housing having side walls, and at least one of said side walls having a hole formed therein being congruent with said hole in said detent clip in said locking position of said detent clip.

11. The plug connector according to claim 10, wherein one of said side walls of said housing has a web-like extension with a continuation extending beyond said opening, and said hole in said one side wall is disposed in said continuation.

* * * * *